US007775688B2

(12) United States Patent
Holland et al.

(10) Patent No.: US 7,775,688 B2
(45) Date of Patent: Aug. 17, 2010

(54) REFLECTOR DEVICE FOR A LIGHTING DEVICE

(75) Inventors: Johann Holland, Schernfeld (DE); Andreas Nittke, Pietenfeld (DE)

(73) Assignee: OSRAM Gesellschaft mit beschrankter Haftung, München (DE)

( * ) Notice: Subject to any disclaimer, the term of this patent is extended or adjusted under 35 U.S.C. 154(b) by 275 days.

(21) Appl. No.: 11/799,827

(22) Filed: May 2, 2007

(65) Prior Publication Data

US 2007/0297180 A1 Dec. 27, 2007

(30) Foreign Application Priority Data

May 2, 2006 (DE) ..... 10 2006 020 224

(51) Int. Cl.
*F21V 7/00* (2006.01)

(52) U.S. Cl. ..... 362/341; 362/296.01; 313/113

(58) Field of Classification Search ..... 362/341, 362/296, 306, 519, 549, 651, 652, 655, 656, 362/657, 658, 659; 313/113; 445/23
See application file for complete search history.

(56) References Cited

U.S. PATENT DOCUMENTS

| | | | | |
|---|---|---|---|---|
| 2,177,216 A | | 10/1939 | Howard et al. | |
| 3,848,120 A | * | 11/1974 | Wolfe et al. | 362/549 |
| 4,429,938 A | * | 2/1984 | Flor | 439/314 |
| 4,608,624 A | * | 8/1986 | Blaisdell et al. | 362/659 |
| 4,855,634 A | * | 8/1989 | Gagnon et al. | 313/113 |
| 6,060,820 A | * | 5/2000 | Noll et al. | 313/113 |
| 6,078,128 A | * | 6/2000 | Gagnon et al. | 313/113 |
| 7,172,317 B2 | * | 2/2007 | Geens et al. | 362/296 |
| 7,227,308 B2 | * | 6/2007 | Rense | 313/623 |
| 7,264,391 B2 | * | 9/2007 | Kaandorp | 362/649 |

FOREIGN PATENT DOCUMENTS

| | | |
|---|---|---|
| DE | 38 09 508 | 3/1988 |
| GB | 248306 | 3/1926 |

OTHER PUBLICATIONS

International Search Report issued in the corresponding European Patent Application No. 07 10 6794.

* cited by examiner

*Primary Examiner*—Jong-Suk (James) Lee
*Assistant Examiner*—David R Crowe
(74) *Attorney, Agent, or Firm*—Cohen Pontani Lieberman & Pavane LLP

(57) ABSTRACT

A reflector device for a lighting device, having a reflector element that has a light emission side and a back side facing away from the light emission side. From the back side to the light emission side, at least one mounting opening is provided, through which an electrically conductive connection element is intended to be passed by its second end region and coupled with the reflector element. The connection element, in turn, serves the purpose of coupling to an individual lamp on the one hand and an electrical power source on the other, and in its first end region it has means for securing the reflector device in a retention device. It furthermore has a third region, adjoining the first end region, that has a round diameter in cross section, and this diameter does not increase between the third region and the second end region. The mounting opening and the connection element are structurally adapted to one another in such a way that the connection element cannot be passed all the way through the mounting opening.

9 Claims, 3 Drawing Sheets

REFLECTOR DEVICE FOR A LIGHTING DEVICE

FIELD OF THE INVENTION

The invention relates to a reflector device for a lighting device.

BACKGROUND OF THE INVENTION

From the prior art, one skilled in the art can find a known reflector device which has two connection elements on a back side that faces away from a light emission side of a reflector element. The connection elements are electrically conductive metal parts, whose outer shape is embodied with the aid of a turning process. The connection elements perform three main functions: First, they make it possible to connect an individual lamp inside the reflector element; second, because of their electrical conductivity, they connect the individual lamp to an electrical power source; and third, they serve to secure the entire reflector device in a retention device.

A reflector device as in the prior art is shown in detail in FIGS. 1 through 3 and corresponds in its construction to types of reflector device that are currently being produced. In such a device, the connection elements are fixed on the reflector element in such a way that they are passed through mounting openings, provided for them, in the back side of the reflector element and are crimped axially from the opposite side. The bracing of the connection elements on the outer side of the back wall that is required for the crimping is assured by a ring embodied on the circumference of the connection elements.

The fact that the connection elements must necessarily have a ring, which besides its bracing function must additionally serve as a stabilizing element to prevent tilting of the connection elements inside the mounting opening, must be considered disadvantageous in this device and in this method. Producing such a connection element in one work step is currently possible only with the aid of turning methods. This has the disadvantage that the turned parts thus obtained are not only complicated to produce but are also subject in particular to the limitation to outer shapes that are rotationally symmetrical. Non-rotationally symmetrical embodiments can be realized as needed in additional work steps—for instance by subsequent milling. However, because of this and because of the great amount of material waste that turning methods fundamentally involve, production becomes still more expensive.

It must also be considered disadvantageous that in a further method step involving costs, a sunken crosspiece, which is capable of receiving the ring embodied on the outer circumference of the connection element, must be made in the back side of the reflector element. This is necessary in order to assure a smooth surface of the back side, since otherwise the reflector device, because of the step formed by the ring, cannot be secured in a retention device intended for it.

SUMMARY OF THE INVENTION

It is therefore an object of the present invention to provide a device and a method of the type defined at the outset which make a simpler and more economical kind of production with reduced waste possible and which overcome the limitation to rotationally symmetrical outer shapes of the necessary connection elements.

According to an embodiment of the invention, the reflector device for a lighting device includes a reflector element with at least one mounting opening on the back side, in which an electrically conductive connection element is disposed. The mounting opening itself preferably has an outline of circular cross section and is embodied as a cylindrical passage through the reflector element. The connection element is structurally adapted to the mounting opening in such a way that it cannot be passed all the way through the mounting opening. This can be assured for instance by a cross section of the connection element that is widened in some regions compared to the diameter of the mounting opening. The connection element itself, below a first end region which has means for securing the reflector device in a retention device, has a third region, embodied with a round cross section and having a predeterminable diameter. In the region between this third region and a second end region of the connection element, which end region in turn is intended to be disposed inside the mounting opening, this predeterminable diameter is at least not exceeded. The connection element, after its partial disposition inside the mounting opening, is coupled to the reflector element. This coupling is preferably effected by crimping the connection element from the light emission side of the reflector element. The connection element itself, in the context of the reflector device, serves not only to receive an individual lamp and to couple this individual lamp to an electrical power source but also to secure the entire reflector device in a retention device. The individual lamp may for instance be a halogen lamp, while the retention device may be a base of the GU10 or GZ10 type. As the reflector element, either full-glass reflectors or reflector elements with a ceramic base may be used. However, still other types of lamp and/or base are also conceivable.

In a reflector device of this kind according to an embodiment of the invention, the fact that it is no longer necessary for a ring to be embodied on the connection element employed is especially advantageous, since the functions performed until now by the ring are realized by means of alternative embodiments of the connection elements. This opens up the possibility of producing the connection elements, instead of by turning processes as before, with the aid of alternative production processes in one work step, economically, even with outer shapes that are not rotationally symmetrical. Additionally, because of the use of different production processes, the material waste that always occurs in the turning processes used until now is eliminated, which is highly advantageous both from an environmental and from a financial standpoint.

Still another advantage, which also results from the elimination of the need to embody a ring on the connection element, is the fact that it is no longer necessary to make a sunken crosspiece on the back side of the reflector element. The reflector element of an embodiment of the invention thus has a continuous wall thickness and consequently has increased stability and security against breakage, compared to a conventional reflector element.

An especially simple version of the reflector device is obtained if the reflector element inside the mounting opening has a locking element. By means of this locking element, not only is a passage of the connection element through the mounting opening prevented, but the locking element also prevents twisting of the connection element inside the mounting opening and thus assures additional stability of the connection element against tilting during assembly.

If the locking element is embodied as a raised structure compared to the inside surface of the mounting opening, the possibility arises in an especially advantageous way of using the locking element both as a brace and as protection against twisting for the connection element during assembly.

Ideally, the locking element is embodied as an elongated crosspiece inside the mounting opening of the reflector element and, besides the advantages already mentioned, additionally offers the function of a guide rail during the introduction of the connection element in the assembly of the reflector device. Instead of an elongated crosspiece, various other geometrical cross-sectional shapes, such as a triangular base, for the locking element are also conceivable. The locking element does not have to extend along the entire inside surface level, either; instead it can equally well be embodied as only a regional protrusion, for instance in the form of a half-ball, on the inside surface.

Particular advantages are obtained if a plurality of connection elements are embodied inside one mounting opening. In that case, the connection elements are preferably embodied as spaced apart from one another in such a way that the mounting opening formally has a multi-digit axis of rotation as a symmetry operator. The embodiment of three locking elements, which in cross section are embodied in the form of an equilateral triangle inside the mounting opening, is especially advantageous. However, an alternative number and disposition of locking elements is also conceivable. Because on the one hand of the increased contact area between the connection element and the mounting opening and on the other the additional bracing points for the connection element, especially high stability and a firm counterhold during the assembly of the reflector device are attained.

To realize the aforementioned advantages especially simply and economically, the connection element, at least in the region which is passed through the mounting opening, has one or more recesses, which ideally are shaped in a corresponding way to the locking element embodied there. The recesses may for instance be slotlike openings along the surface of the connection element, as a result of which not only is the security against twisting inside the mounting opening made possible, but a simple means for bracing the connection element on the back side of the reflector element during crimping can also be realized. This eliminates the necessity of having to make a crosspiece, embodied in sunken form relative to the back side of the reflector element, in an additional method step, since the connection element no longer has to have a ring. A resultant further advantage is that the back side without the crosspiece can have a thicker, uniform cross section, which assures additional mechanical stability.

An especially stable and economical device is attained by providing that the connection element has a steplike embodiment, which represents an especially simple means for bracing the connection element on the back side of the reflector element. The embodiment can be combined with additional recesses in the part of the connection element that is passed through the mounting opening, so that all the stabilizing means, which make assembly easier and reduce costs, can be realized in a single component.

Since the reflector device, as part of a lighting device, can be coupled with an electrical power source, such as a halogen lamp, an especially useful arrangement has two mounting openings on the back side of the reflector element, with one connection element fixed in each. As a result, the individual lamp can not only be held in the reflector device but at the same time it can be coupled to a current source, in particular a direct current source, and each connection element is connected to one electrical pole.

In a method according to an embodiment of the invention, it is provided that first a reflector element is furnished, which has a light emission side and a back side facing away from the light emission side. At least one mounting opening is provided on the back side. The reflector element is preferably a full-glass reflector or a ceramic reflector element. The mounting opening may be provided already in the production of the reflector element or may be made only later in the reflector element. In the next step, a connection element is embodied that is then introduced into the mounting opening. In contrast to the previous turning process, an embodiment with the aid of a solid forming process is especially preferred. It has also proved especially advantageous to pass the connection element all the way through the mounting opening, so that a portion of the end region is located inside the reflector element. In the concluding step of the method embodiment, the reflector device is embodied by coupling the connection element to the reflector element. The coupling is advantageously realized by a crimping step, in which the end region, passed through the mounting opening, of the connection element is bent at a right angle from the light emission side of the reflector element, thus achieving a permanent connection of the two workpieces.

Advantageous features of the device can be considered as advantageous features of the disclosed method.

For the disclosed method, it is also considered advantageous that the solid forming process for embodying the connection element includes an extrusion process. By the extrusion process, instead of by the turning process as before, even non-rotationally symmetrical, complex outer contours can be produced in one operation. The production of complex shapes can be understood to mean the most various asymmetrical features, such as the making of recesses in the connection element. Such an embodiment furthermore opens up the possibility, in combination with an additional method step, of making further recesses in the connection element. For instance, additional slots may be made in the connection element by thermal cutting processes, especially laser cutting processes, so that the connection element is to be secured to the reflector element by a releasable bayonet mount, instead of by a permanent crimping step. A further advantage of extrusion is that in contrast to turning methods, no material waste occurs. As a result, a marked reduction in effort and expense for the production process can be attained. As suitable material, all materials that are not only suitable for extrusion processes but are also electrically conductive can be considered, thus in particular metals such as aluminum, or metal alloys such as brass.

An additional cost reduction is attained within the scope of an embodiment of the method of the invention in that the required mounting opening on the back side of the reflector element need not already be made in the production thereof. Instead, the mounting opening, in an especially preferred and cost-reducing way, can be made in the reflector element by a water-jet cutting process, before the disposition of the connection element. An advantage of this procedure is moreover that to suit a given situation, mounting openings can be produced with an embodiment that is individually adapted to the particular connection element, yet still with low production tolerances. The various embodiments may for instance include different locking elements or different diameters or geometries of the mounting opening. In this way, different types of reflector element can be combined with different shapes of mounting opening and different types of connection element within the same method, in virtually arbitrary fashion, to make many conceivable reflector devices.

Further advantageous features will become apparent from the exemplary embodiments described below.

BRIEF DESCRIPTION OF THE DRAWINGS

Exemplary embodiments of the present invention are described in further detail below in conjunction with schematic drawings.

DETAILED DESCRIPTION OF THE DRAWINGS

Figure 1:
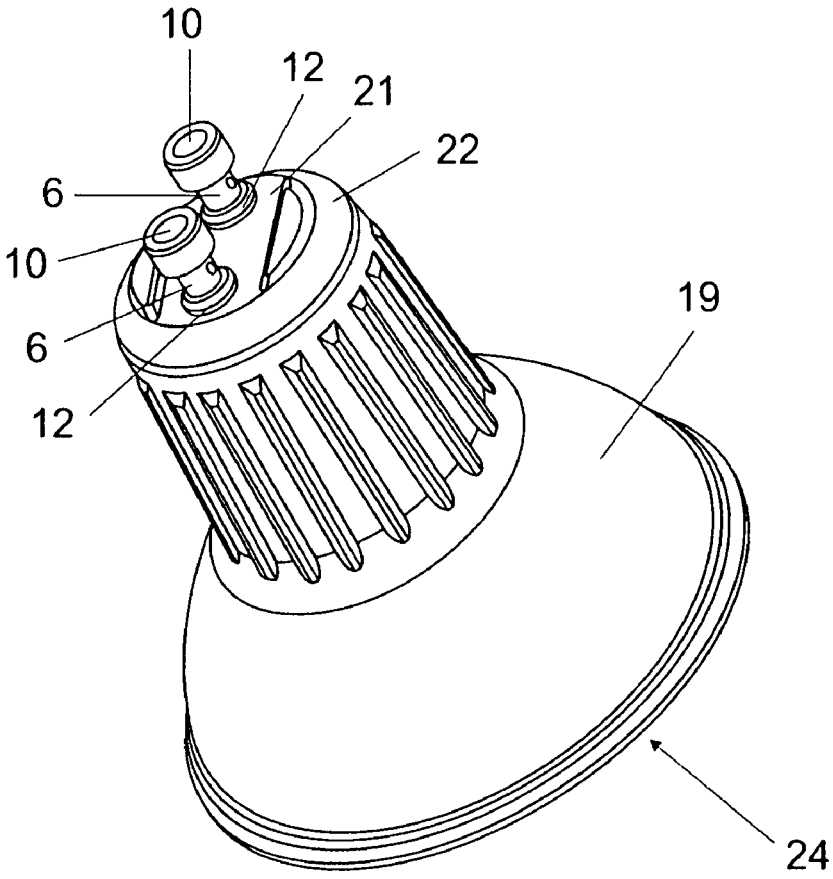
FIG 1 ( PRIOR ART )
FIG. 1 is a perspective rear view of a reflector device for a base of the GU10/GZ10 type in the prior art.

In the drawings, elements that are identical or functionally the same are provided with the same reference numerals.

In FIG. 1, a reflector device for a lighting device is shown, of the kind known by one skilled in the art from the prior art. It includes a known reflector element 19, with a light emission side 24 and a back side 22, in which sides two mounting openings 18 of circular cross section are made. Disposed inside the mounting openings 18 are connection elements 6, known from the prior art, which are connected to the reflector element. Each connection element 6 has one end region 10 disposed outside the reflector element 19 and designed in accordance with the retention device to be used; by means of this end region, the entire reflector device is meant to be secured in a retention device, not shown. In addition, on the circumference of each connection element 6, a ring 12 is embodied which not only prevents tilting of the connection element 6 in the mounting opening 18 but also acts as a counterhold upon connecting the connection element 6 to the reflector element 19. Because of the raised structure of the ring 12 compared to the surface of the back side 22, a crosspiece 21 embodied in sunken form must be made in the back side 22 of the reflector element 19, in order to achieve a flat surface and thereby to enable securing the reflector device in the retention device.

Figure 2:
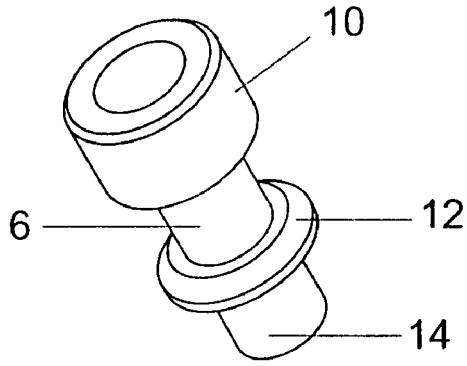
FIG 2 ( PRIOR ART )
FIG. 2 is a perspective rear view of a connection element of FIG. 1.

FIG. 2 shows a connection element 6 of FIG. 1, which is embodied rotationally symmetrically as a turned part. For producing a reflector device of the prior art, this element is introduced by an end region 14 into a mounting opening 18 in the reflector element 19 and is connected, from the light emission side 24, to the reflector element 19, for instance by crimping. Once again, the ring 12 on the circumference of the connection element 6 is clearly shown, which is intended as a counterhold and to protect against passage and tilting.

Figure 3:
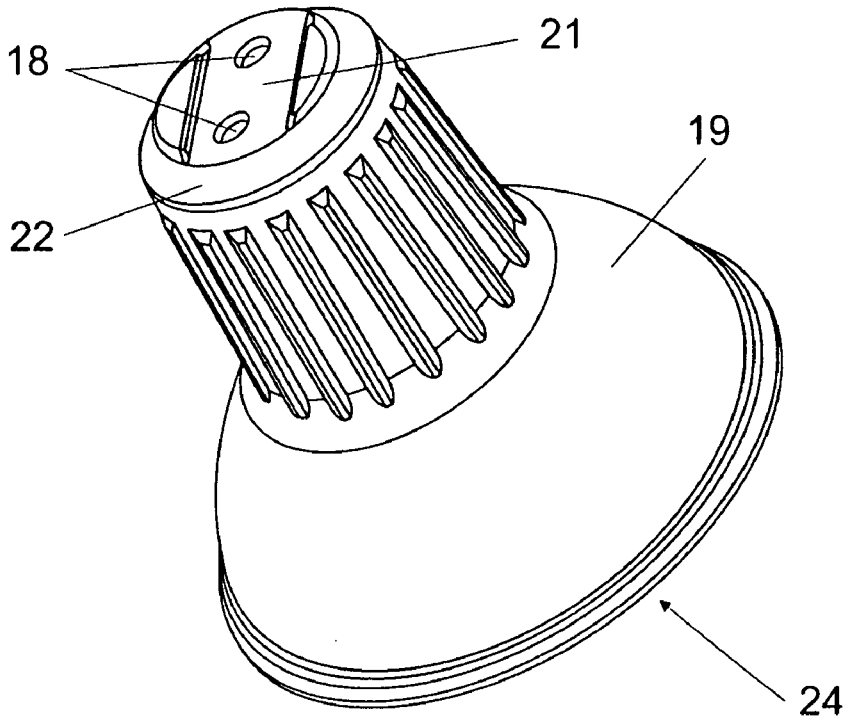
FIG 3 ( PRIOR ART )
FIG. 3 is a perspective rear view of a reflector element of FIG. 1.

The reflector element 19, which is part of the reflector device of the prior art, is shown individually in FIG. 3 for the sake of further illustration. Since the connection element 6 to be introduced into the mounting opening 18 must, because of its production process, be rotationally symmetrical, the associated mounting openings 18 on the back side 22 of the reflector element 19 must also be embodied with a circular cross section, to prevent tilting of the connection element 6 to be disposed in the mounting openings 18.

Figure 4:
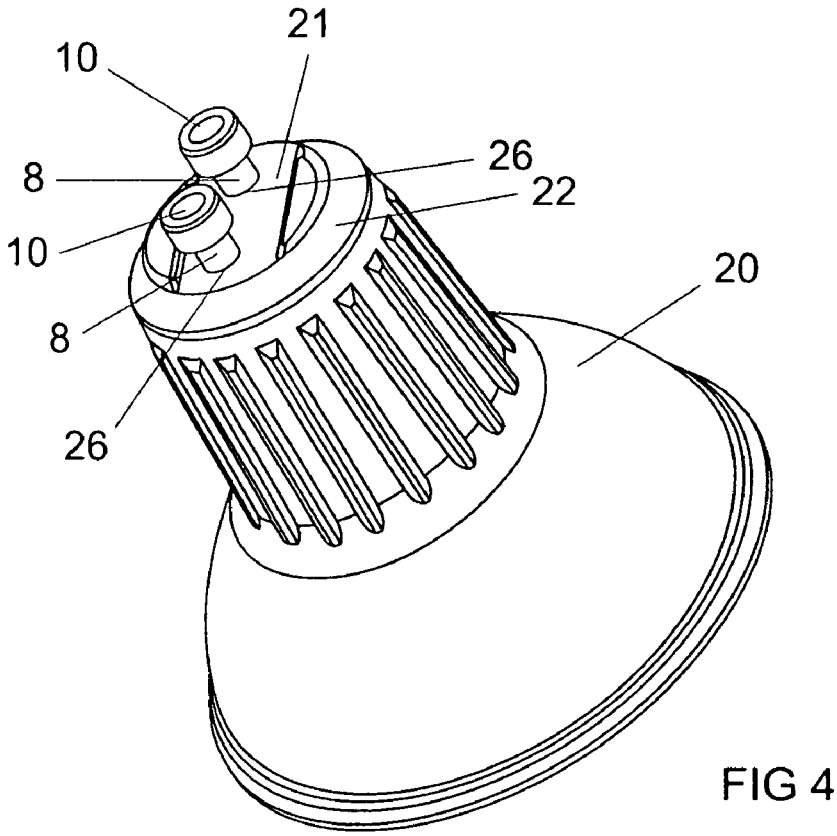
FIG. 4 is a perspective rear view of one possible embodiment of a reflector device of the invention.

FIG. 4 shows an exemplary embodiment of a reflector device of the invention in a perspective rear view. A reflector element 20 with a light emission side, not shown, and a back side 22 diametrically opposite the light emission side has two mounting openings 26, in each of which one connection element 8 of the invention is disposed. Because of the specifications of the standard, depending on the retention device to be used, the end regions 10 of the connection elements 8 located outside the reflector element 20 of FIGS. 1 and 2 are embodied identically to the end regions of the known connection elements 6. The reflector element 20 in this exemplary embodiment, like the reflector element 19 of the prior art, has a crosspiece 21 embodied in sunken fashion on its back side 22, but to realize a reflector device of the invention this crosspiece is not necessary and can be omitted and not replaced.

Figure 5:
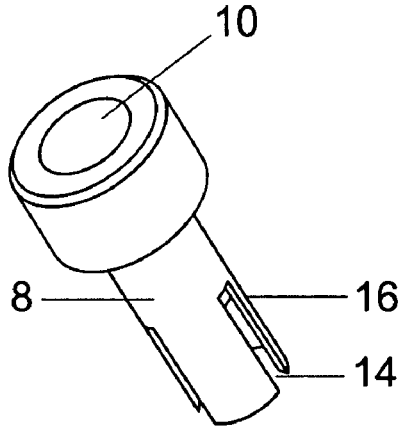
FIG. 5 is a perspective rear view of one possible embodiment of a connection element of the invention of FIG. 4.

A connection element 8 of the invention, used in FIG. 4, is shown in FIG. 5 in a perspective rear view. Since the production of this connection element 8 is done by a material forming method such as an extrusion process, the limitation to rotationally symmetrical shapes is eliminated. The connection element 8 has a plurality of recesses 16, associated with its end region 14 that is to be introduced into the mounting opening 26.

Figure 6:
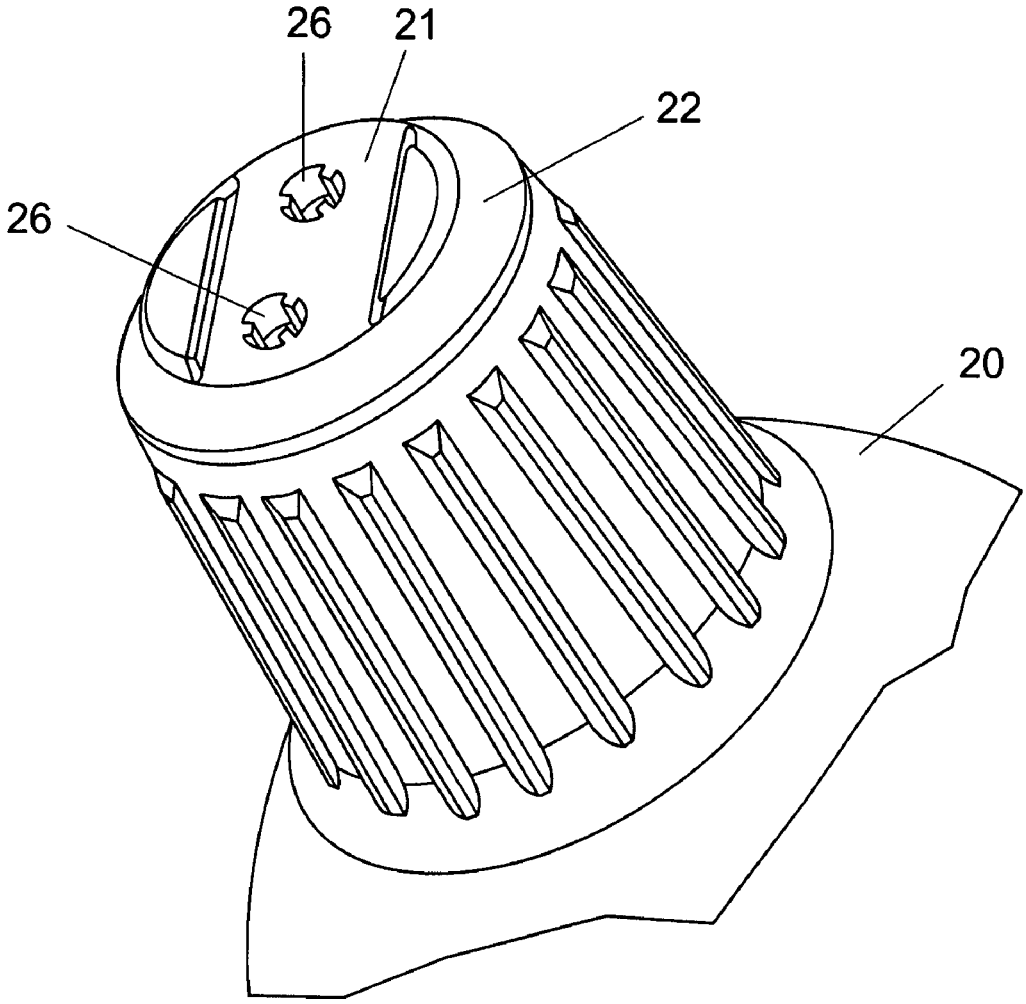
FIG. 6 is a perspective rear view of one possible embodiment of a reflector device of the invention of FIG. 4.

One embodiment of the reflector element 20 for a reflector device of the invention as shown in FIG. 4 is shown in a schematic side view in FIG. 6. The locking elements embodied inside the mounting openings 26 correspond to the recesses 16 of the connection element 8 shown in FIG. 5 and in collaboration with it act simultaneously as a leadthrough protection, as a bracing element, and as protection against twisting.

We claim:

1. A reflector device for a lighting device, the reflector device comprising:

at least one reflector element, with a light emission side and a back side facing away from the light emission side;

at least one mounting opening, which is provided at the back side of the at least one reflector element, the at least one mounting opening extending from the back side of the reflector element to the light emission side; and at least one electrically conductive connection element, adapted to be coupled both to at least one individual lamp and to an electrical power source, and which has at least one first region and one second region at first and second ends of the at least one connection element, wherein the first and second regions are diametrically opposed end regions, the at least one connection element having means, associated with the first end region, for securing the reflector device in a retention device;

wherein the at least one connection element has a third region, embodied with a round cross-section and with a predeterminable diameter, which third region adjoins the first end region;

wherein in a fourth region between the third region and the second end region, the connection element has a cross-section with a diameter that is at most equal to the diameter of the third region;

wherein the connection element, in at least some regions, is passed with the second end region through the mounting opening;

wherein the connection element is coupled to the reflector element, and wherein the at least one mounting opening has at least one locking element comprising a raised structure disposed inside the mounting opening and raised relative to an inside surface of the mounting opening, the raised structure being received in and interacting with at least one recess in the fourth region of the connection element when the second end of the connection element is passed through the mounting opening to prevent twisting of the connection element in the mounting opening and to prevent passage of the connection element all the way through the mounting opening.

2. The reflector device as defined by claim 1, wherein the locking element is embodied as an elongated crosspiece.

3. The reflector device as defined by claim 1, wherein the mounting opening has a plurality of raised structures, which are spaced apart from one another.

4. The reflector device as defined by claim 1, wherein the connection element has at least one steplike embodiment.

5. The reflector device as defined by claim 1, wherein the reflector element includes two mounting openings, which are disposed at a predeterminable spacing from one another.

6. The reflector device as defined by claim 1, wherein the at least one recess axially extends to the second end of the connection element.

7. A method for producing a reflector device for a lighting device, the method comprising the steps of:

a) providing a reflector element, having a light emission side and a back side facing away from the light emission side;

b) providing at least one mounting opening from the back side to the light emission side;

c) providing at least one locking element inside the at least one mounting opening, the at least one locking element embodied as a raised structure, relative to an inside surface of the mounting opening;

d) embodying at least one electrically conductive connection element;

e) disposing the connection element inside the mounting opening of the reflector element, wherein the locking element interacts with the connection element to prevent twisting of the connection element in the mounting opening and to prevent passage of the connection element all the way through the mounting opening; and f) coupling the connection element to the reflector element, the connection element adapted to be coupled both to at least one individual lamp and to an electrical power source, and the connection element having means for securing the reflector device in a retention device, wherein step d) includes at least one solid forming process.

8. The method as defined by claim 7, wherein the solid forming process in step d) comprises an extrusion process.

9. The method as defined by claim 7, wherein the mounting opening of the reflector element is made by means of a water-jet cutting process.

* * * * *